United States Patent [19]

Gallagher

[11] Patent Number: 4,757,995

[45] Date of Patent: Jul. 19, 1988

[54] APPARATUS FOR IMPROVING THE HITTING TECHNIQUE OF BASEBALL PLAYERS

[76] Inventor: David T. Gallagher, 22 Pasadena Dr., Mercerville, N.J. 08619

[21] Appl. No.: 11,265

[22] Filed: Feb. 5, 1987

[51] Int. Cl.[4] ..... A63B 69/40

[52] U.S. Cl. ..... 273/26 C; 273/189 R; 434/255

[58] Field of Search ..... 273/189 R, 26 R, 26 C, 273/188 A; 119/128; 59/86; 70/18; 272/143, DIG. 2, 126, 125; 434/255, 247

[56] References Cited

U.S. PATENT DOCUMENTS

| | | | |
|---|---|---|---|
| 267,877 | 11/1882 | Gustaveson | 119/128 |
| 705,556 | 7/1902 | Bostwick | 119/128 |
| 953,818 | 4/1910 | Chambers | 119/128 |
| 1,189,865 | 7/1916 | Paulson | 119/128 |
| 2,450,162 | 9/1948 | Prome | 273/189 R |
| 4,239,228 | 12/1980 | Norman et al. | 273/189 R |

*Primary Examiner*—Richard C. Pinkham
*Assistant Examiner*—T. Brown
*Attorney, Agent, or Firm*—Sachs & Sachs

[57] ABSTRACT

An apparatus for improving the hitting technique of baseball players, suitable for use in training right and/or left hand hitters includes a stride limiting apparatus having an adjustable elongated restraining member for limiting the length of a player's stride during hitting of a baseball, a pair of removable and adjustable cuff members disposed proximate each ankle of the player utilizing the apparatus and a non-resilient adjustable restraining device affixed to each of the cuff members.

6 Claims, 1 Drawing Sheet

APPARATUS FOR IMPROVING THE HITTING TECHNIQUE OF BASEBALL PLAYERS

BACKGROUND OF THE INVENTION

1. Field of the Invention

The present invention relates to devices for the training and improvement of the hitting capabilities of a baseball batter, and more specifically relates to a simplified apparatus affixed to the players ankles which limits his stride during baseball practice and/or training 2. Discussion of the Relevant Art Well known coaches and power hitters actively engaged in the sport of baseball have over many years attempted to impart their technique and knowledge to other members of the team during training to increase their ability to hit a baseball. With the pitchers today throwing the ball at what is believed to be faster speeds and being able to provide movement of the ball in various directions, it is necessary for the batter to keep his eye on the ball, once it leaves the pitcher's hand, as it approaches him to be able to have the bat in his hand meet the ball with a maximum of force and direction so that the batter may improve and/or maintain a respectable batting average, hopefully, 0.300 or better. Well known baseball player and power hitter, Johnny Bench, in his book "Catching and Power Hitting", Copyrighted in 1975, at page 100, when discussing the techniques utilized by other renowned baseball players mentioned that players have different techniques. "Mel Ott put his front leg straight up as the pitch was coming in, then moved it forward to hit. Joe DiMaggio simply picked up his foot from an initially wide stance and set it back down again. Ott overstrided, DiMaggio understrided, but both got excellent results. The point is, both took some kind of stride to help their batting motion." Today when major league coaches are training their players to improve their hitting they are taught not to overstride and they recommend that the stride not be more than six to eight inches greater than their normal batting stance to prevent the player from pulling his shoulders away from the plate and moving his head, thus losing eye contact with the ball. In Pete Rose's book, Copyrighted, 1976, and entitled "Winning Baseball" he suggests at page 29, that the stride taken by a hitter should be "no more than six inches". Reggie Jackson in his book "Inside Hitting" Copyrighted in 1975, states that "A stride should never be more than eight to ten inches long". Above all, he suggests that a stride that is too long should be avoided because it starts too much body movement and there is a good possibility the hitter will lose sight of the ball.

In "Pitching and Hitting" by Nolan Ryan and Joe Torre, Copyrighted in 1975, at Page 123 the authors state "A lot of hitting problems develop because the length of the stride unbalances the hitter. An overstride is definitely a detriment to a hitter. You will never hit consistently if you overstride because the longer your stride the longer it is going to take for your bat to catch up with you. With the kind of pitching we have in the big leagues and pitchers with tremendous velocity like Nolan Ryan, it is impossible to hit well if you are overstriding because you tend to get out on your front foot, which means you are going to have to drag the bat into the ball. Then, even if you hit the ball with the fat of bat, the ball is going to be flat and lifeless. It will not go anywhere because you have already spent all your power by being out on that front foot." In "The Eye of Hitting 0.300" by Charlie Lau with Alfred Glossbrenner, Copyrighted in 1980 they state "The problem of how far to stride can be one of the more troubling questions in hitting, especially for baseball coaches. . . . You see, although the actual feet-and-inches distance of the stride is determined by the player's body type, generally speaking, a relatively short stride provides better balance, timing and control." Thus, over the years it is readily apparent that most strong hitters and coaches agree that controlling the length of the stride is critical and is one of the major factors in determining the consistent hitting ability of a batter.

In order to prevent batters from overstriding numerous techniques have been utilized one of which is set forth "The Complete Book of Baseball Instruction" by Dell Bethel, Copyright 1978 wherein during training a player is positioned on a table with a second player lying beneath the table and throwing a ball upwardly into view of the batter (hitter). If the batter were to overstride he would fall off the table. This is rather a drastic approach to take since the player could be injured if he fell off the table, however, it demonstrates some of the extremes taken by coaches in training their players to reduce their stride and thus, improve their batting averages.

Therefore, it is an object of the present invention to provide a simple, portable, compact apparatus which baseball players may use during training and/or practice to limit their batting stride.

It is another object of the present invention to provide a simple apparatus that may be adjustable in size to fit or be readily modified to accommodate players having different stances and strides.

It is yet another object of the present invention to provide an inexpensive apparatus which may be utilized by coaches to train their batters by limiting their stride.

It is still another object of the present invention to provide an adjustable mechanism to limit the stride of batters during practice and/or training which is completely adjustable as far as stride and adaptability for attachment to a player.

SUMMARY OF THE INVENTION

An apparatus for improving the hitting technique of baseball players, according to the principle of the present invention, comprises an adjustable elongated restraining member for limiting the length of a player's stride when hitting a baseball; a pair of removable affixing devices one of each being affixed to the ankle of a baseball player and means for connecting each of the affixing devices to the adjustable restraining member.

The foregoing and other objects and advantages will appear from the description to follow. In the description, reference is made to the accompanying drawing which forms a part hereof, and in which is shown by way of illustration a specific embodiment in which the invention may be practiced. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, and will now be described, by way of example, with reference to the accompanying drawing in which.

DESCRIPTION OF THE PREFERRED EMBODIMENT

Figure 3:
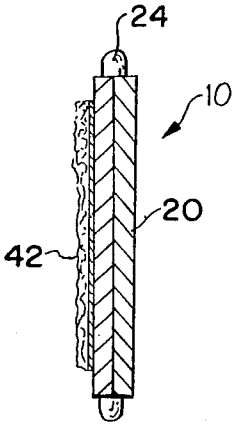
FIG. 3 is a cross-sectional view taken across lines 3—3 shown in FIG. 2.
Figure 1:
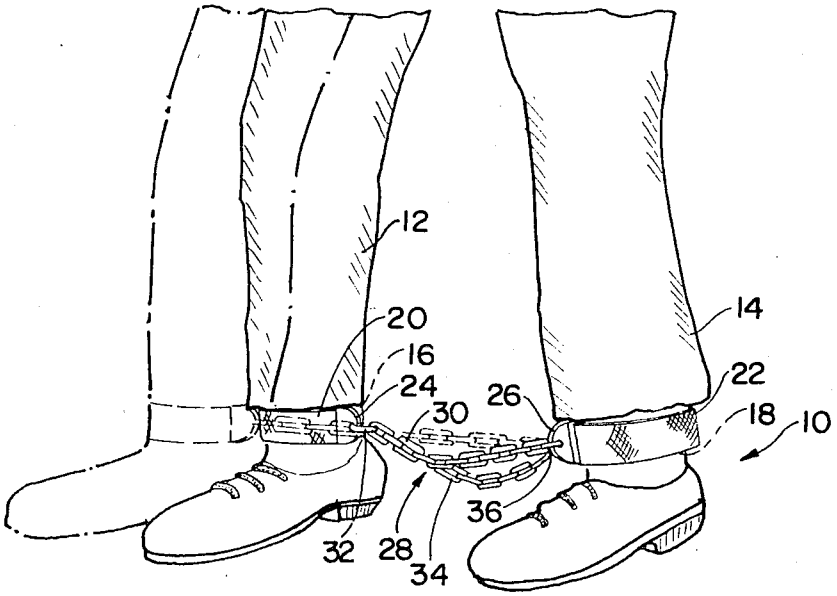
FIG. 1 is a partial pictorial representation of a baseball batter having the apparatus, according to the principles of the present invention, affixed to his ankles.
Figure 2:
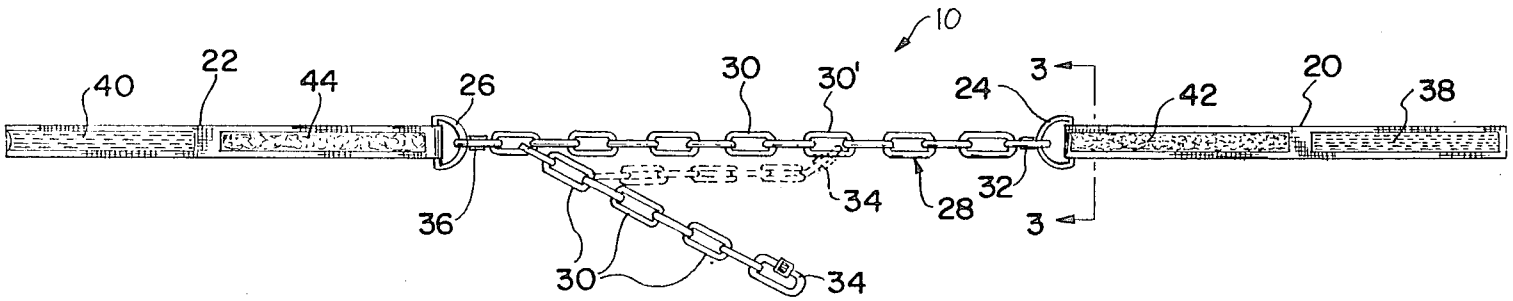
FIG. 2 is a side-view in elevation with the restraining apparatus having both cuff members in an extended position.

Referring to the figures, and in particular to FIGS. 1 and 2 there is shown the legs 12 and 14 of a baseball player, not shown, in the normal position for hitting a baseball. Affixed on the ankles 16 and 18 of the baseball player, is a stride restraining apparatus 10 which includes a pair of cuff members 20 and 22, one each being affixed on the ankles 16 and 18 of the player. The cuff members 16 and 18 are fabricated from a relatively soft cushioned material, preferably, and are adaptable to be readily adjusted to fit the ankle of the player and may be readily removed therefrom (See FIG. 3). Each of the cuff members are provided with D-rings 24 and 26, or the like or any other suitable ring-like member which may be affixed, in a conventional manner to the cuff members, either by a portion of the cuff member being folded in half and then stitched or the cuff member may be fed through the rings 24 and 26 and stitched its entire length thus, permanently affixing the rings to the cuff members.

An elongated restraining device 28 preferably fabricated from a plurality of links (metal or plastic) 30 is provided with a pair of quick-links 32 and 34 disposed on both distal ends of the restraining device 28 intermesh with the distal links 30; a quick-link being any link that may readily be opened and reclosed. One quick-link 36 engages ring 26 while the other quick-link 32 engages ring 24 disposed on cuff 20 to determine and set the maximum distance between the legs 12 and 14 of the player, thus determining the maximum stride of the player wearing the apparatus 10. The excess chain links 30 are restrained from causing a player to trip thereover by affixing or engaging the quick-link 34 to link 30′, as shown in dotted lines in FIG. 2. Thus, the unused portion of the restraining device 28 is kept from getting in the way of the player during his batting practice.

The cuff members 20 and 22 are preferably provided with a plurality of hooks 38 and 40 which are adapted to mate and cooperate with a plurality of eyes 42 and 44 disposed along the length of the cuff members 20 and 22, respectively. The same effect of hooks 38 and 40 and eyes 42 and 44 may be accomplished with the use of VELCRO disposed along the areas 38 and 40 in FIG. 2 with the eyes or loops being provided by the mating VELCRO material utilized for areas 42 and 44, thus, making the adjustability and removability of the cuff members 20 and 22 from the ankles 16 and 18 of the player readily accomplishable. Areas 38 and 40 may be on the same side of the cuffs 20 and 22 as areas 42 and 44 or areas 38 and 40 may be disposed on the other surface (opposite side) of the cuff material.

In operation, the cuff members 20 and 22 will be placed comfortably around the ankles of a batter with the areas 38, 40, 42 and 44 kept away from contacting the ankles of the player by threading the free end of the cuff members through the rings 24 and 26 and then reversing the areas 38 and 40 back upon themselves to contact areas 42 and 44, respectively. Alternatively, if areas 38 and 40 are on opposite sides than areas 42 and 44 the free ends of the cuff members are threaded through the rings 24 and 26 until they contact areas 42 and 44, respectively. The cuff member may include additional padding so that there is less chance of abrading of the skin of the player or alternatively, the cuff members may be placed over his socks to prevent contact with the batter's skin. One end of the restraining device 28, having quick-link 32 disposed thereon, is connected to ring 24 and the quick-link locked in position. The batter or hitter then would take his position at the plate, not shown, and get set in a comfortable stance that he is utilizing during batting practice. The restraining device is then spread along the direct path between the ankles of the player and six to eight additional inches are added to the restraining apparatus 10 beyond the stance distance and quick-link 36 is connected to a link 30, occurring at that point, and then closed. The excess amount of the restraining device 28 is placed out of the way as shown by the dotted lines in FIG. 2, wherein quick-link 34 is connected to a convenient link 30′ occurring between the ankles of the player so that the player's stance may only be increased to a stride which is only six to eight inches longer than his conventional stance. Thus, as a ball approaches the batter he is prohibited from increasing the distance between his ankles greater than set by the restraining device 28, thereby forcing the batter to reduce his stride to an acceptable distance, thereby permitting him to keep his eye on the ball at all times. Since his weight, hands and shoulders will not be displaced to any great extent, he will remain well balanced.

Hereinbefore has been disclosed an inexpensive simple method for training hitters during training and batting sessions to maintain a stride which is no more than six to eight inches longer than the player's conventional stance. It will be understood that various changes in the details, materials, arrangement of parts and operating conditions which have been herein described and illustrated in order to explain the nature of the invention may be made by those skilled in the art within the principles and scope of the instant invention.

Having thus set forth the nature of the invention, what is claimed is:

1. An apparatus for improving the hitting technique of baseball players, comprising:
   (a) adjustable elongated restraining means having two ends for limiting the length of a player's stride when hitting a baseball; and
   (b) a pair of removable relatively soft cuffs, one of said pair of cuffs being affixable upon each ankle of said baseball player, one of said cuffs being non-adjustably affixable to one end of said restraining means, first closed locking means removably and adjustably connecting the other of said cuffs to said restraining means at a predetermined position remote from said one cuff, second closed locking means removably connecting the other end of said restraining means along the length of said restraining means between said cuffs.

2. An apparatus for improving the hitting technique of baseball players according to claim 1 wherein said elongated restraining means is fabricated from a flexible non-longitudinally expandable material.

3. An apparatus for improving the hitting technique of baseball players according to claim 1 wherein said restraining means comprises a metal chain and each cuff is disposed through a ring member and said closed locking means is a quick-link coupled to said ring member.

4. An apparatus for improving the hitting technique of baseball players, comprising:

(a) a finite length metal chain having a plurality of links, said chain being provided with first and second closed locking quick-links, said first quick-link being connected intermediate the ends of said chain;

(b) a pair of removable and adjustable cuff members fabricated from a relatively soft cushioned material, each cuff member having a ring member affixed thereon; and (c) connecting means non-adjustably connecting one end of said chain to a ring member on one of said cuff members said first chain quick-link being removably connected to the ring member on said other cuff member, for limiting the length of a player's stride and said second chain quick-link being connected to the other end of said chain and removably connected to a metal chain link intermediate said pair of cuff members.

5. An apparatus for improving the hitting technique of baseball players according to claim 4 wherein said cuff members are adjusted by means of a plurality of hook and eye members disposed along the length of said cuff members.

6. An apparatus for improving the hitting techniques of baseball players, comprising:

(a) adjustable elongated restraining means having two ends for limiting the length of a player's stride when hitting a baseball;

(b) a pair of removable relatively soft cuffs, one of said pair of cuffs being affixable upon each said ankle of said baseball player;

(c) a pair of ring members, one of said ring members circumscribing each said cuff, one of said ring members non-adjustably connecting one end of said restraining means to a said cuff;

(d) first closed locking quick-connect link means releasably connecting an intermediate portion of said restraining means to said other ring member; and (e) second closed locking quick-connect link means releasably connecting the other end of said restraining means along the length of said restraining means between said cuffs.

* * * * *